US005092463A

United States Patent [19]

Dees

[11] Patent Number: 5,092,463

[45] Date of Patent: Mar. 3, 1992

[54] TOOL STORAGE CONTAINER

[76] Inventor: Kent L. Dees, 8385 Lake Ben Ave., San Diego, Calif. 92119

[21] Appl. No.: 652,014

[22] Filed: Feb. 7, 1991

[51] Int. Cl.[5] ..... B65D 85/20

[52] U.S. Cl. ..... 206/373; 29/469; 211/70.6

[58] Field of Search ..... 29/401.1, 469; 206/15.2, 15.3, 209, 372, 373; 211/60.1, 62, 69, 70.6

[56] References Cited

U.S. PATENT DOCUMENTS

| | | | |
|---|---|---|---|
| 402,679 | 5/1889 | Leggett | 206/15.3 |
| 2,815,863 | 12/1957 | Larson | 211/70.6 |
| 3,298,531 | 1/1967 | Wilcke | 211/70.6 |
| 3,298,532 | 1/1967 | Wilcke | 211/70.6 |
| 3,532,221 | 10/1970 | Kaluhiokalani et al. | 211/70.6 |
| 3,759,538 | 9/1973 | Fabiano | 211/70.6 |
| 4,362,243 | 12/1982 | DeYesso et al. | 211/70.6 |
| 4,867,332 | 9/1989 | Mains | 220/85 R |
| 4,947,998 | 8/1990 | Smeller | 220/85 D |
| 5,004,103 | 4/1991 | Connors et al. | 206/372 |

FOREIGN PATENT DOCUMENTS

| | | | |
|---|---|---|---|
| 0946691 | 7/1956 | Fed. Rep. of Germany | 206/209 |
| 2559415 | 8/1985 | France | 211/70.6 |
| 0385436 | 3/1965 | Switzerland | 211/69 |

*Primary Examiner*—Jimmy G. Foster

*Attorney, Agent, or Firm*—Brown, Martin, Haller & McClain

[57] ABSTRACT

A tool holding apparatus is designed for fitting inside the open top of an appropriate container and includes a plate member with hooks around its periphery for suspending the member in a horizontal orientation from the upper peripheral rim of the container. The plate has a plurality of openings for receiving the handles of tools which are inverted with their handles projecting through the plate member into the interior of the container, and a tubular extension or sleeve projects from each opening downwardly into the container for maintaining the tool handle in a generally vertical orientation.

5 Claims, 1 Drawing Sheet

TOOL STORAGE CONTAINER

BACKGROUND OF THE INVENTION

The present invention relates to an apparatus and method of tool storage and more particularly to portable tool storage using easily available containers.

The storage of long-handled tools has been approached from many angles ranging from simply leaning the tool in a corner to hanging the tools from a rack to providing a wheeled rack to allow portability.

The practice of leaning tools against a wall or corner is clearly the most inexpensive storage method, however, it is also the most inconvenient. Tools that are merely leaned against a wall can fall if not balanced property, and if many long-handled tools are stored together, a person wanting to select a particular tool will often have to sift through the array of handles, finding the desired tool by trial and error.

A tidier method of storage of similar simplicity to the leaning method involves placing the tools, handle down, in a large container such as a trash can. This method is particularly attractive in that people will not want to use a trash can for refuse if the can lid has been lost, which frequently occurs. This leaves an unused receptacle which can either be disposed of or be used for another purpose such as tool storage. The drawbacks of this method are that an array of tools is still cluttered such that it may require searching to find the desired tool, and the tools must be carefully balanced so that the weight will not shift to one side of the container causing it to tip over.

Wall-mounted racks are commonly available to neatly suspend the tools in a parallel manner which allows the desired tool to be readily selected. These racks lack portability which may be desired if multiple tools are to be used at a location remote from the storage rack. As a result, when multiple tools are taken to the work site, they will most likely be set aside in a disorganized array which presents the same problem as the first method.

Various types of tool carts are available for portable storage. These carts are convenient but can be relatively expensive and are likely to be used only by professionals or serious gardeners with a large yard to tend.

A reasonable compromise which provides a relatively inexpensive and portable storage means for use with a trash can or the like is disclosed in U.S. Pat. No. 3,298,532 issued to Wilcke. This device includes a two-piece combination of a lid with circular openings to receive a tool handle and a dome-shaped insert for the bottom of the container to maintain the tools in a generally vertical position. The disadvantage of such a device is that the lid must be made the exact size to fit the container and the insert must be made to be reasonably close in diameter to the bottom of the container. This requires than an individual set of supports be made for every possible container size.

It would be desirable to provide a simple and inexpensive means for tool storage which is portable and versatile enough to be adapted to fit a wide range of container sizes. It is to such an apparatus that the present invention is directed.

SUMMARY OF THE INVENTION

It is an advantage of the present invention to provide a tool storage means which converts a container such as a trash can or bucket to permit various tools to be held generally vertically for convenient removal and replacement.

It is a further advantage of the present invention to provide a tool storage means which is adaptable to fit many sizes and shapes of containers.

It is another advantage of the present invention to provide a tool storage means which permits ready transportation of the entire storage means and its contents.

It is still another advantage of the present invention to provide a simple, inexpensive storage means which requires no additional parts or modification of the container.

In an exemplary embodiment, a flat plate member fits horizontally across the inside top of an open container such as a trash can, barrel or bucket. A plurality of openings with diameters sufficiently large to receive a slender elongated handle such as would be used on a rake, hoe, broom or the like.

A tubular projection extends downward from each opening, the tubular projection having an inner diameter capable of receiving the tool handle and providing a means for containing a sufficient length of the handle to maintain the tool in a generally vertical position.

At the edges of the plate are a plurality of flanged brackets for suspending the plate form the edges of the container. These brackets may be adjustable to permit increasing or decreasing the effective diameter of the storage device to permit use of the device with a wide range of containers. The quantity of hanging brackets is preferably four which permits use of a circular plate in a square container if desired, as well as providing good stability in a cylindrical container. The shape of the plate is not limited to that of a circle—as many shapes may be provided as there are types of containers with which the device will be used.

With the tools held firmly in a generally vertical orientation, the container can be readily moved from place to place because there is no risk of a sudden weight shift which may either injure the user or cause the container to become unmanageable. Ideally, a galvanized or plastic trash can with handles could be used. A wheeled trash can or container would also provide easy portability.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DETAILED DESCRIPTION OF THE PREFERRED EMBODIMENTS

Figure 1:
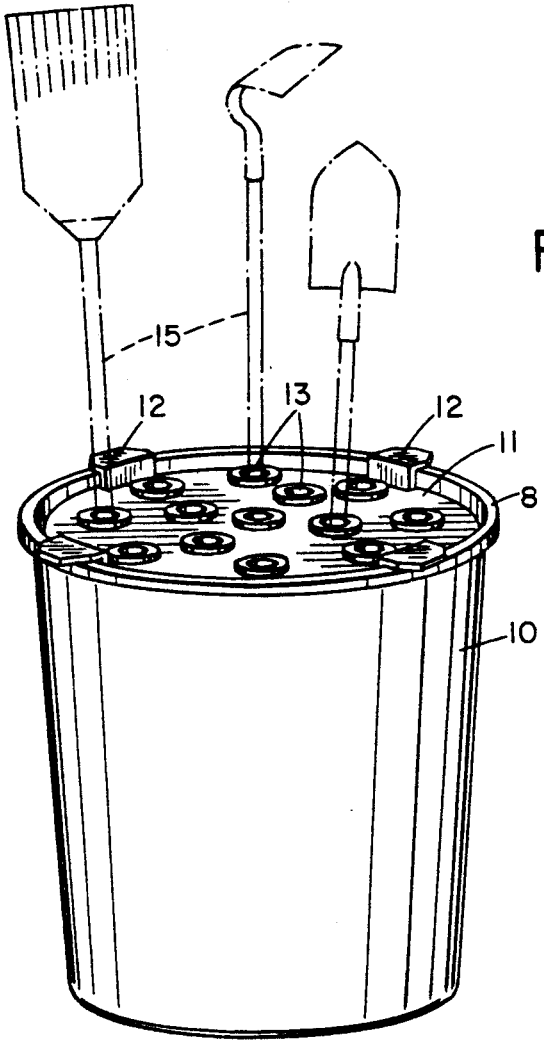
FIG. 1 is a perspective view of the tool holder of the present invention disposed inside a container with tools stored therein.
Figure 2:
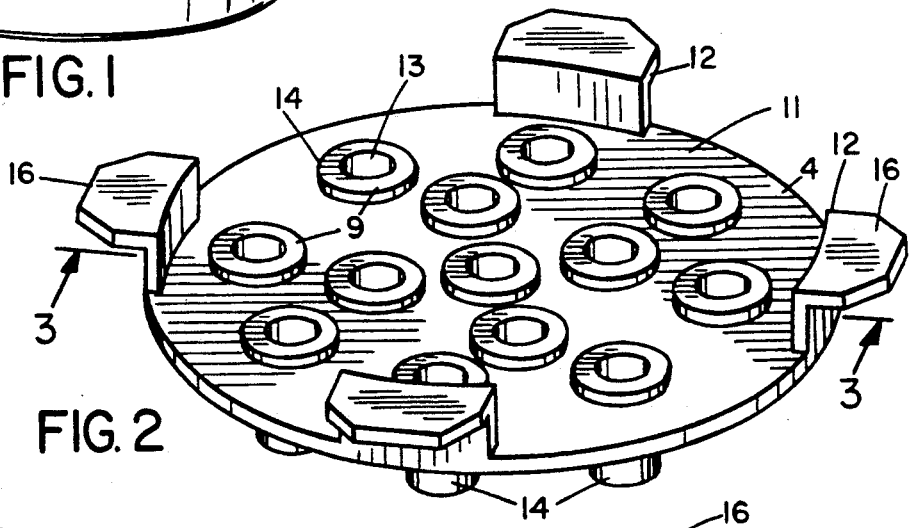
FIG. 2 is a perspective view of the tool holder.

As shown in FIGS. 1 and 2, the tool holder 1 is formed to fit the inner diameter of container 10. Tool holder 1 comprises flat plate 11 with a plurality of holes 6 therethrough with a flanged pipe 14 extending through each hole 6. Hooks or brackets 12 are disposed at the perimeter 4 of plate to suspend the plate 11 inside container 10 slightly below its upper rim 8.

Plate 11 is preferably made of a dense polymer or plastic such as polypropylene. The thickness of the plate is not critical as long as the plate retains sufficient rigidity to support the tools in a vertical manner against the shifting weight of the tools. The holes 6 may be formed as part of the molding process for plate 11 or may be cut after creation of the plate. The diameter of each hole 6 is sufficiently large to accept pipe !4 which in turn is sufficiently large to accept a tool handle. Plate 11 may also be formed from wood or metal, in which case the holes 6 will be cut or machined.

Pipe 14 may be either a separate piece inserted into hole 6 or may be formed as a single piece with plate 11 during the molding process when the plate is plastic. When inserted pipes are used, a flange 9 is placed at the top of pipe 14 to serve as a stop to keep the pipe in place. Pipe 14 and flange 9 may be molded as a single piece or flange 9 may be a separate piece such as a short piece of pipe to provide a collar of a larger diameter than pipe !4. A second flange may also be located at the bottom portion of pipe 14, below the plate 11. The outer diameter of pipe 14 is sized to closely fit the inner diameter of hole 6 so that pipe 14 will not rotate or slip within the hole. The inner diameter 13 of pipe 14 is large enough to loosely accept a tool handle 15. Allowance should be made for a wide range of tool handle diameters so that the largest handle can be accommodated. The length of pipe 14 is generally on the order of three to four inches (75 to 100 mm), but any length may be used as long as sufficient support is provided to maintain the tool handles 15 in a vertical orientation.

Figure 5:
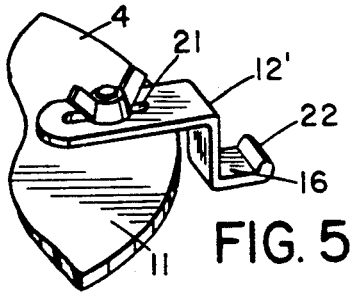
FIG. 5 is a perspective view of the bottom side of the tool holder with a slidable bracket.
Figure 3:
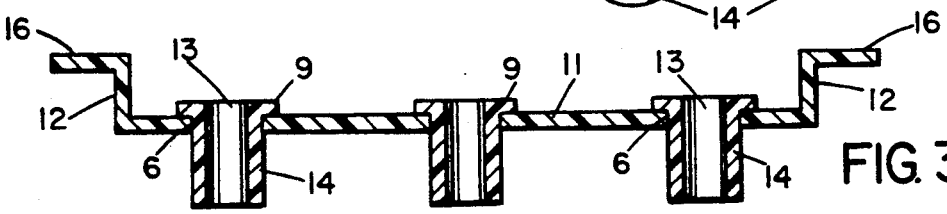
FIG. 3 is a cross-sectional view taken along line 3—3 of FIG. 2.

Brackets 12 are attached at the perimeter 4 of plate 11. In the preferred embodiment, four L- or hook-shaped brackets 12 are used, providing stable support of a circular plate in a cylindrical container. In an arrangement where the four brackets are evenly spaced, a circular tool holder 1 can also be used in a square container which has a width on the order of the diameter of the tool holder. The brackets 12 may be molded at the same time as the plate 11, as shown in FIGS. 2 and 3, or they may be separately added, as illustrated in FIG. 5. Where separate brackets 12 are used, they will preferably be made of a strong metal or plastic and may be attached such that they are adjustable to cover a wide range of container diameters. In the latter embodiment, a slot 21 may be provided in the lower extension of bracket 12' where it attaches to the plate 11 to permit sliding inward or outward with respect to the perimeter 4. Wing nuts or other easily adjustable fasteners may be used with screws or bolts extending from the plate to hold the bracket in place after lengthening or shortening the lower extension of the bracket. The upper extension 16 may have a lip 22 at its outermost edge to catch on the outer edge of the container rim 8.

Figure 4:
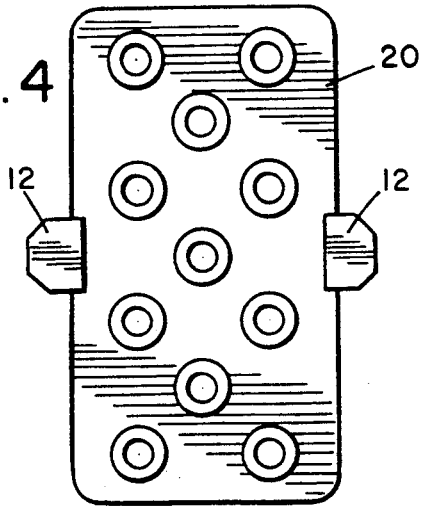
FIG. 4 is a top plan view of an alternate embodiment for rectangular containers.

The shape of plate 11 is not limited to a circle. For uses with square or rectangular buckets or containers, an appropriately-shaped plate may be formed. As shown in FIG. 4, a rectangular plate 20 is provided for use in a common rectangular household bucket, permitting mops and brooms to be conveniently stored.

The tool storage device of the present invention provides an inexpensive means of converting a commonly available container into a convenient, portable storage rack. Only a single unit is required for the conversion, and no assembly tools are necessary. The tools are neatly and safely stored so that they are separated from each other and conveniently available, reducing clutter and annoyance when a particular tool is to be selected. Further, the tool holder is not strictly limited to long-handled tools. A combination of long- and short-handled tools may be stored, for example, rakes, hoes and shovels may be stored alongside hand trowels and pruning shears, so that a full range of gardening tools are immediately at hand.

It will be evident that there are additional embodiments which are not illustrated above but which are clearly within the scope and spirit of the present invention. The above description and drawings are therefore intended to be exemplary only and the scope of the invention is to be limited solely by the appended claims.

I claim:

1. A tool storage device comprising:

a plate member for fitting horizontally inside the open top of a container, the plate member having opposite upper and lower faces and a plurality of openings for receiving the handles of tools extending through the openings into the container;

a plurality of brackets for suspending the plate member in a generally horizontal orientation from an upper peripheral rim of the container, each of said plurality of brackets having a slidable portion to permit adjustment of an effective diameter of said tool storage device; and a series of tubular projections at least on the lower face of the plate member, each tubular projection extending from a respective one of the openings and comprising means for receiving the handle of a tool extending through the respective opening into the container and for maintaining the tool handle in a generally vertical orientation.

2. The tool storage device as claimed in claim 1, wherein said tubular projections comprise flanges for resting on the upper face of the plate.

3. The tool storage device as claimed in claim 1, wherein said plate member and said series of tubular projections are formed as a single unit.

4. The tool storage device as claimed in claim 1, wherein said suspending means and said plate member are formed as a single unit.

5. A method of tool storage which comprises:

forming a plate member to fit within a diameter of an open container;

forming a plurality of openings through said plate member, each opening of said plurality having a diameter for loosely receiving tool handles;

slidably attaching suspending means to said plate member for suspending said plate member generally horizontally within said open container;

disposing a tubular projection in each opening such that it extends from said plate member, said tubular projection for receiving said tool handles; and suspending said plate member from an upper peripheral rim of said open container so that a tool handle inserted into said tubular projection is held in a generally vertical orientation.

* * * * *